US008215986B1

(12) United States Patent
Wallace

(10) Patent No.: US 8,215,986 B1
(45) Date of Patent: Jul. 10, 2012

(54) CABLE CONNECTION METHOD PRIORITY

(76) Inventor: Henry B. Wallace, Fincastle, VA (US)

( * ) Notice: Subject to any disclaimer, the term of this patent is extended or adjusted under 35 U.S.C. 154(b) by 504 days.

(21) Appl. No.: 12/460,800

(22) Filed: Jul. 24, 2009

Related U.S. Application Data

(60) Provisional application No. 61/135,974, filed on Jul. 25, 2008.

(51) Int. Cl.
*H01R 9/05* (2006.01)

(52) U.S. Cl. ..... 439/580

(58) Field of Classification Search ..... 439/581, 439/580; 29/882, 869; 174/72 R, 88 R, 92; 156/49, 55, 56
See application file for complete search history.

(56) References Cited

U.S. PATENT DOCUMENTS

| | | | | |
|---|---|---|---|---|
| 2,694,182 | A | | 9/1954 | Edlen, et al. |
| 3,543,222 | A | | 11/1970 | Rheinfelder |
| 3,625,623 | A | | 12/1971 | Rheinfelder |
| H0113 | H | | 8/1986 | McNeel |
| 4,738,009 | A | * | 4/1988 | Down et al. ..... 29/33 M |
| 4,822,434 | A | * | 4/1989 | Sawaki et al. ..... 156/48 |
| 4,963,699 | A | * | 10/1990 | Urushibata et al. ..... 174/88 R |
| 5,151,050 | A | | 9/1992 | Scholz et al. |
| 5,347,090 | A | * | 9/1994 | Cerda ..... 174/84 R |
| 5,456,791 | A | * | 10/1995 | Ueno ..... 156/556 |
| 5,679,008 | A | | 10/1997 | Takahashi et al. |
| 5,885,514 | A | * | 3/1999 | Tensor ..... 264/478 |
| 6,146,196 | A | | 11/2000 | Burger et al. |
| 6,439,929 | B1 | | 8/2002 | Jenets |
| 7,267,575 | B1 | * | 9/2007 | Hwang ..... 439/497 |
| 7,430,881 | B2 | | 10/2008 | Bryant et al. |
| 2009/0305521 | A1 | * | 12/2009 | Yang et al. ..... 439/56 |

OTHER PUBLICATIONS

Atlantic Quality Design, Inc., The Zerocap(TM) Audio Cable, Web Page http://www.aqdi.com/zerocap.htm, Printed on Jul. 24, 2009.

* cited by examiner

*Primary Examiner* — Alexander Gilman

(57) ABSTRACT

The cable connection method is a method of connecting to conductors within a triaxial electrical cable, without completely severing the cable, allowing compact, low cost connections to be made while having the added benefit of strain relief of the cable around the connection point and even within the cable itself.

12 Claims, 3 Drawing Sheets

CABLE CONNECTION METHOD PRIORITY

PRIORITY

This application claims priority through U.S. Provisional Application No. 61/135,974 filed by Henry B. Wallace on Jul. 25, 2008 for "Low Capacitance Audio Cable."

BACKGROUND OF THE INVENTION

1. Field of the Invention

The cable connection method is a method of connecting to conductors within a triaxial electrical cable, without completely severing the cable, allowing compact, low cost connections to be made while having the added benefit of strain relief of the cable around the connection point and even within the cable itself.

2. Description of the Prior Art

Coaxial cables have been in use for many years. A common problem is connecting to a coaxial cable to access the signal on the inner conductor of the cable without completely severing the cable. Many inventions have been created to aid the goal of connecting to coaxial cables, typically by puncturing or removing part of the outer shield and insulation to access the inner conductor. These will be reviewed, and their applicability in connecting to triaxial cables evaluated.

For the purposes of reference, a triaxial cable is considered to have a first center conductor, an inner tubular shield conductor situated around the first center conductor and separated from it by a dielectric material (with optional semiconductive outer layer for handling-noise suppression), an outer tubular shield conductor situated around the inner shield conductor and separated from it by an additional dielectric material, and an overall insulating layer.

Edlen, et al. (U.S. Pat. No. 2,694,182, Nov. 9, 1954) discloses a coaxial cable tap that pierces the outer insulator, shield and inner insulator to contact the center conductor using a hinged clamp assembly. Peripheral probes contact the shield to connect it electrically to other coaxial cables. While this performs suitably with coaxial cables, triaxial cables have and additional conducting layer that would require impractical piercing parts to connect to each conductor, such piercing parts being specially insulated and demanding critical positioning.

A functionally similar method is disclosed in Rheinfelder (U.S. Pat. No. 3,543,222, Nov. 24, 1970), and consists of a coaxial cable tap that pierces the outer insulator, shield and inner insulator to contact the center conductor and route its signal to one or more other coaxial cables. For triaxial cable connection, this is impractical, as cited for Edlen, above.

Rheinfelder (U.S. Pat. No. 3,625,623, Dec. 7, 1971) describes a method of accessing the conductors in a coaxial cable using a boring tool situated radially with respect to the central axis of the cable. Such a boring method adequately exposes the center conductor in a coaxial cable, but would not adequately also expose the inner shield conductor in a triaxial cable such that it could be easily connected to.

Down, et al. (U.S. Pat. No. 4,738,009, Apr. 19, 1988) discloses a coaxial cable tap that removes a semicircular section of the cable, then connects to the shield and center conductor using a clamping shell assembly. This method and assembly results in a coaxial cable tap construct that appears from the drawings to be approximately 10 to 15 times the cable diameter in length, which is unacceptably large. However, removal of a semicircular section of a triaxial cable would allow access to all three conductors and connection thereto.

The prior art is concerned with making connections to coaxial cables as are typically used in cable television distribution and radio frequency systems, where the connections must be made without interrupting service to customers, and where the impedance of the completed connection must not disturb the signals or system. In the case of a connection being made during factory assembly of a product, interruption of service is not an issue, and simpler methods may be used. With audio cables and systems, the characteristic impedance of the cable and connections is not important. While the prior art regarding coaxial cable taps provides some direction, it does not provide a solution that affords compact, low cost, strain relieved connections to audio triaxial cable.

After an electrical connection is made to a cable, it is also important to stabilize the connection against physical damage and encroaching moisture and contaminants. This is typically done with a sealing gasket or potting (encapsulating) operations. Of interest here are strain reliefs formed using epoxy or other potting compounds, as opposed to discrete molded plastic strain reliefs or seals.

For example, Jenets (U.S. Pat. No. 6,439,929, Aug. 27, 2002) discloses a standard strain relief application: "Often times, these terminating backshells are intended to be filled with a potting compound, such as at non-conductive epoxy or the like, which will protect soldered wire joints from the environment and to prevent corrosion, while at the same time providing some degree of strain relief to soldered wire joints." Similar disclosure is found in Burger, et al. (U.S. Pat. No. 6,146,196, Nov. 14, 2000): "After termination, the back end of the coaxial contact system would be potted with epoxy to further lock in place and to provide strain relief."

Takahashi, et al. (U.S. Pat. No. 5,679,008, Oct. 21, 1997) describes a similar strain relief: "It is preferable that the vinyl jackets 54 of the coaxial cables 5 are fixed to the circuit boards 41 with epoxy resin in order to reinforce the attachment of the coaxial cables 5, providing strain relief."

The prior art is replete with examples of the use of epoxy resins as stabilizing, sealing, and strain relief agents when used in the construction of cable connections. However, not disclosed is the possibility and express intention that the epoxy used in the potting process wicks into the cable along the interfaces between the various members of the cable's structure, cures there, and provides strain relief actually within the structure of the cable itself.

Bryant, et al. (U.S. Pat. No. 7,430,881, Oct. 7, 2008) discloses an optical fiber termination means where epoxy wicks into a tube around a fiber: " . . . the pigtail 102 may be heated to wick epoxy up through the maria 205. The protective sleeve 203 may then be reinserted and the epoxy allowed to cure (e.g., via UV curing), thus providing strain relief and securing the protective sleeve 203 without interfering in the optical path." However, there is no disclosure of the epoxy wicking into the structure of the fiber to provide a strain relief, and all strain relief is external to the fiber.

McNeel (U.S. Registration No. H113, published Aug. 5, 1986) discloses an electrical cable termination and sealing method: "A select epoxy resin 84, such as type CN-874 manufactured by Mereco Company infills housing 82, surrounding the ends of the pins and sockets such as 52 and 60 within flanges 72, the laced wire conductors 66 and 68, brace stem 76, and a predetermined length of cable 14. The epoxy resin 84 forms a watertight seal within housing 82 and reacts chemically with cable 14 firmly anchoring it within the housing." Here there is still no disclosure of epoxy encapsulant wicking into the structure of the cable and forming a strain relief.

Objects and Advantages of the Cable Connection Method

Several objects and advantages of the cable connection method are:

1. Connections to the triaxial cable can be made in a small space, typically two to four diameters of the cable in length.
2. No elaborate clamping or shell arrangement is needed, and the frame for encapsulation of the connection may be inexpensive plastic.
3. Connections to the cable may be easily wired by soldering wires to the exposed conductors of the cable.
4. The entire connection area is potted in epoxy, which then wicks into the cable, creating a strain relief.
5. The assembly method requires no high tolerance machined parts or expert assembly skills, and can be accomplished with inexpensive materials.
6. The completed connection is impervious to moisture and contaminants.

SUMMARY OF THE INVENTION

The cable connection method is a method of connecting to conductors within a triaxial electrical cable, without completely severing the cable, resulting in compact, low cost connections with strain relief and contaminant resistance.

DETAILED DESCRIPTION

Figure 1:
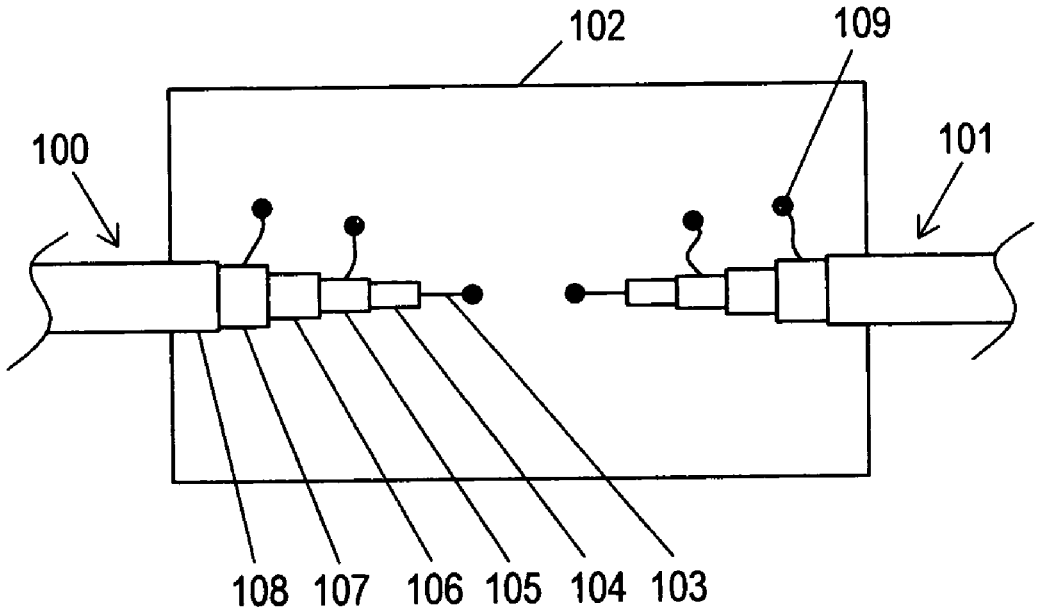
FIG. 1 (PRIOR ART)
FIG. 1 is a drawing of a typical method of connection of two triaxial cables to a printed circuit board (PCB).

This application involves connecting to the three conductors of a triaxial cable, typically connecting those conductors to a PCB for some signal processing operation, for example a driven shield capacitance reduction scheme. In the past, such a connection was made as in FIG. 1, which shows a first triaxial cable 100, a second triaxial cable 101, each having a first center conductor 103, an inner shield conductor 105 situated around the first center conductor 103 and separated from it by a dielectric material 104, and an outer shield conductor 107 situated around the inner shield conductor 105 and separated from it by a yet additional dielectric material 106, with an overall insulating layer 108. Identically stripped lengths of each cable are shown, though various lengths and arrangements may be used depending upon the application. A PCB 102 receives soldered connections 109 to the cable conductors, either the conductors themselves or using additional lead wires, as shown in Scholz, et al. (U.S. Pat. No. 5,151,050, Sep. 29, 1992), FIG. 3, and in the specification: "The ground braid 34 is electrically connected to a corresponding terminal 28 by means of a wire 35 surrounding the ground braid 34 and soldered thereto."

Such an assembly is labor intensive to construct in that the cables 100 and 101 must be precisely stripped (all stray braid conductors accounted for and restrained), and each of six conductors must be soldered to the PCB 102.

Figure 2:
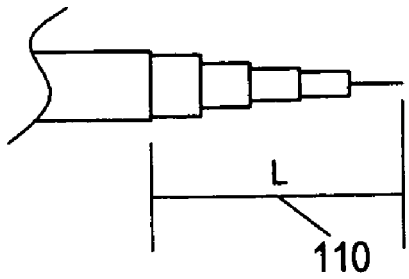
FIG. 2 is a drawing of a typical stripping profile of a triaxial cable.

Another disadvantage of the method if FIG. 1 is that the size of the assembly is large. FIG. 2 illustrates the stripping profile of a typical audio triaxial cable, where length "L" 110 is typically 1.5 cm to 2 cm. Thus for an inline connection the length would be at least 3 cm. The cables may be overlapped to some extent to reduce that dimension, but such overlap increases the width required on the PCB.

It would be better to tap the cable in some way that saves labor and space.

While many methods exist for tapping or connecting to coaxial cable, such methods do not directly apply to triaxial cables due to the additional shield conductor. Tapping elements that pierce the triaxial cable would have to be constructed with fine dimensions in order to contact a single conductor of the three, especially regarding the two inner conductors. Such tapping elements would also have to be positioned with great precision to avoid shorting to other conductors, and to make contact as intended.

Coaxial cable tapping methods are also generally designed to not disturb the impedance of the coaxial cable because they carry radio frequency (RF) energy. Any impedance perturbations on an RF coaxial cable, for example, in a cable television system, can produce line reflections that foul signal delivery to the customer. Thus coaxial RF tapping methods must be precise and as noninvasive as possible.

With audio cables, the impedance of the cable is relatively unimportant, especially for low-level signal cables. This permits other, less stringent methods to be used to tap or access the signals on the cable. This also allows optimization of other parameters, such as the space occupied by the tap arrangement.

The present cable connection method is not affected by the existence or lack of the noted optional semi-conductive layer within a triaxial cable, and as such this feature is not considered further except to say that it should be trimmed properly in the preparation of any connection assembly, which is standard procedure in the prior art.

PREFERRED EMBODIMENT

Figure 3:
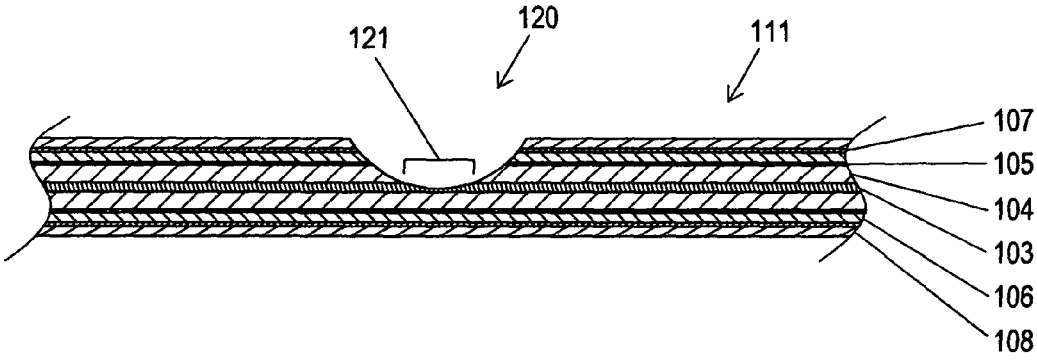
FIG. 3 is a drawing illustrating an alternative, compact method of accessing the conductors within a triaxial cable.

Referring to FIG. 3, to access the conductors in a triaxial cable 111 it is acceptable to remove a section from the side of the cable. This may be done by grinding, milling, or cutting, or by using another prior art method, as in Down, et al., but with the improvement that the center conductor is exposed in the process. (The method disclosed in Down, et al. leaves the center conductor fully enveloped in dielectric.) Cooling the cable before the removal process helps stiffen the cable and attain a cleaner cut. Such methods work as well on triaxial cable as on coaxial cable, and exposes all three conductors in a semicircular exposed area 120 of extent on the order of the diameter of the cable, typically less than 5 mm for an audio cable. A length 121 of center conductor 103 is exposed in this process, but the conductor is not completely severed.

Figure 4:
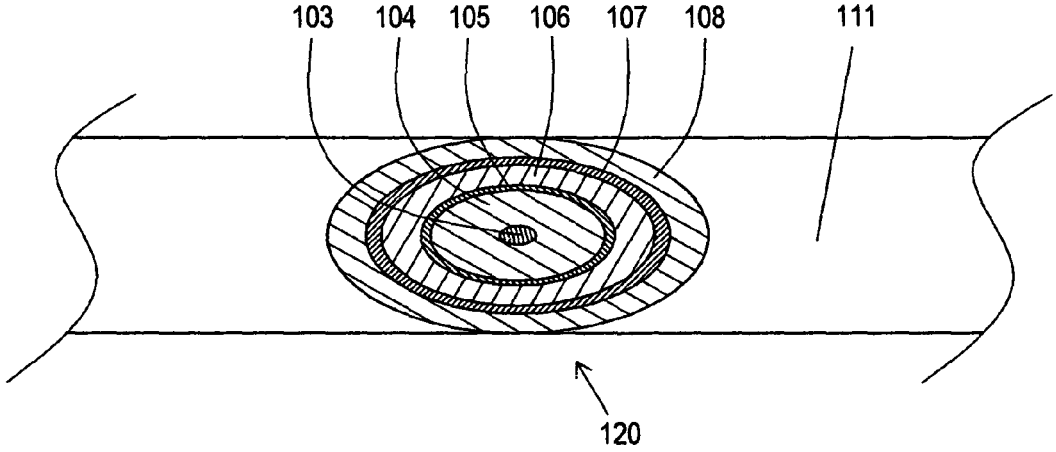
FIG. 4 is a drawing illustrating another view of the conductors within a triaxial cable after removal of a section of the cable.

Another view of the exposed semicircular area 120 is shown in FIG. 4. All three conductors of triaxial cable 111 are available for connection, including first center conductor 103, inner shield conductor 105, and outer shield conductor 107, as designated in FIG. 1.

Figure 5:
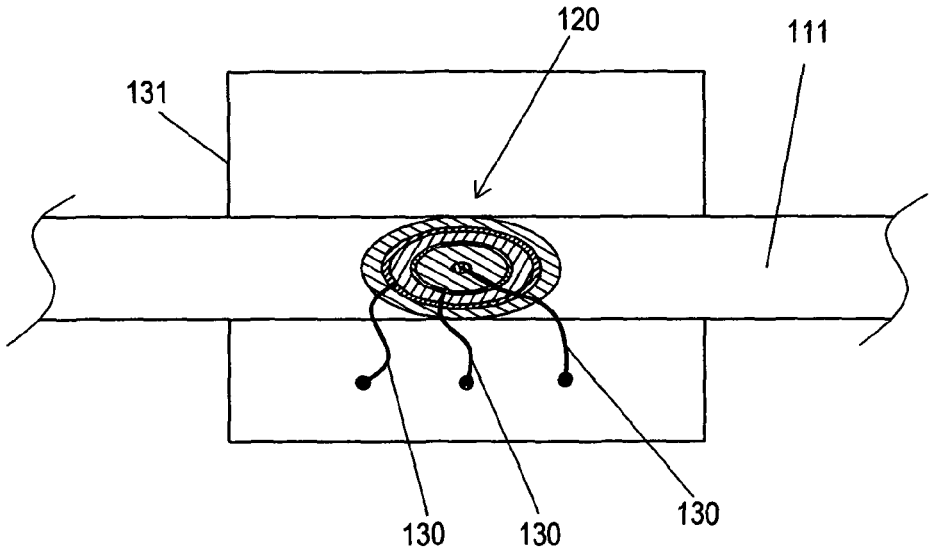
FIG. 5 is a drawing illustrating connection of a triaxial cable to a PCB using the compact method of conductor access.

Referring to FIG. 5, after the semicircular section of cable 111 is removed, creating an exposure 120, it is a simple matter to solder wires 130 onto the three cable conductors and connect them to a PCB 131. The wires 130 may also be attached to the three cable conductors using mechanical pressure or conductive adhesive. Since this is an application for an audio signal cable, and the currents flowing are generally much less than 1 milliamp RMS, the wires may be of fine gauge.

It is also feasible to use conductors captured in a connector at fixed spacing, instead of discrete wires. Such conductors may be soldered to the three cable conductors, or maintained in contact using physical pressure or conductive adhesive.

Figure 6:
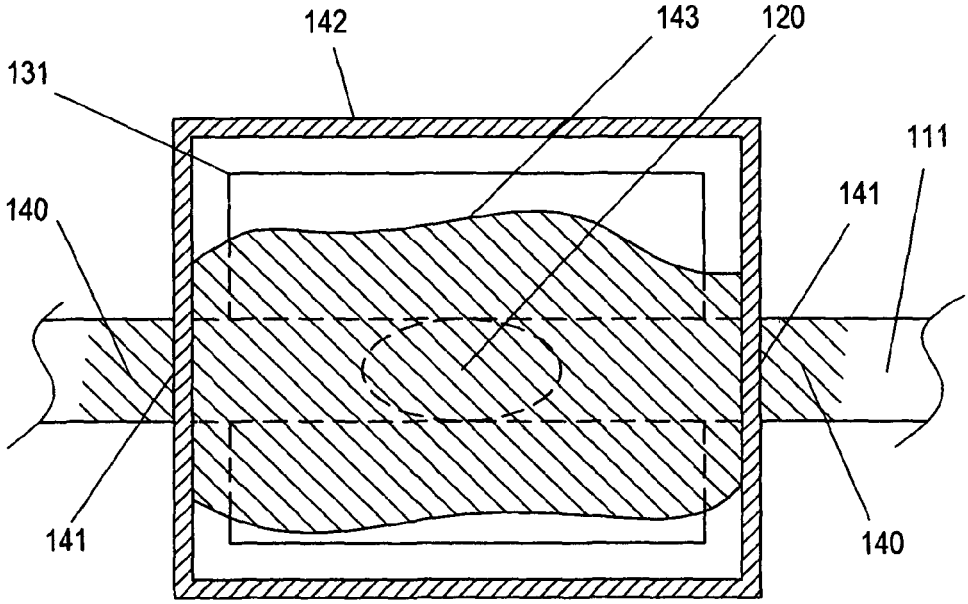
FIG. 6 is a drawing illustrating the potting of the exposed area of a triaxial cable and connected PCB, and the wicking action that provides strain relief to the cable.

FIG. 6 shows the assembly after being potted with epoxy, for example MG Chemicals type 832B. The critical feature here, unexpected and not disclosed in the prior art, is that the epoxy 143 wicks into the internal structure of the cable 111 through exposure 120 to a distance of 1 cm-2 cm, providing a strain relief 140 inside the cable 111 after the epoxy cures. The internal structure of the cable consists of the components of the cable within the outer layer 108 (not shown in FIG. 6). Such wicking generally occurs to a greater extent along the outer shield 107, which is acceptable because a strain relief there will protect cable structures within. The cable 111 is shown exiting a plastic or metal potting enclosure 142 through apertures 141 in the walls, the apertures fitting the cable 111 snugly. Each aperture 141 does not compress the cable 111 as in a typical mechanical strain relief. Thus the epoxy wicks inside the cable 111 past the wall of the enclosure 142.

Note that the potting enclosure and wall are not strictly required, and the epoxy wicks into the cable in any case, providing some strain relief against flexure of the cable where it enters the main mass of cured epoxy.

With this assembly technique, a strain relief 140 is created without the need for discrete rubber or plastic strain relief parts, and the strain relief is contained within the cable 111 and is not visible. The net effect is that the cable 111 is stiffer near the enclosure wall 142, retarding wire breakage near the wall as the cable 111 is repeatedly flexed.

The epoxy 143 wicking action also serves to reinforce the exposed section of the cable 120 where the semicircular wedge has been removed (the dashed oval in FIG. 6). This restores the cable 111 to a useful and sufficient tensile strength in the vicinity of the connection area. Enhanced wicking and strain relief may be had by potting the assembly under vacuum to draw more of the epoxy into the cable structure. It should be understood that this operation might include positive pressure as needed, depending on the specific configuration of the equipment.

Note that the references to strain relief with regard to potting cable assemblies in the prior art assume that the entire mechanical advantage of the potting compound occurs entirely on the outer surface of the cable, and the exposed conductors and insulators thereof. No statement of the advantage of the wicking of the epoxy into the cable is made, and this potential benefit is neglected.

Marketing by applicant of an audio cable featuring the cable connection method, after the filing of U.S. Provisional Application No. 61/135,974, has been successful. The audio cables have been praised by professional musicians, and the cables have withstood the typical abuse received from working musicians without failure.

The specific configuration of the embodiments discussed should not be construed to limit implementation of this cable connection method to those embodiments only. The techniques outlined are applicable to embodiments in other physical formats, using various methods of exposing the conductors in the triaxial cable, using various connection methods to the conductors in the cable, and using various potting compounds. The cable connection method is functional with a broad range of electrical cable, not just coaxial or triaxial cable. These techniques, structures and methods find applicability outside the realm of audio cables. Therefore, the scope of the invention should be determined not by the embodiments illustrated, but by the appended claims and their legal equivalents.

What is claimed is:

1. A method of making connections to a triaxial cable comprising the steps of:

(a) removing by milling a section of material from the side of said triaxial cable to expose the three conductors therein without completely severing any of said three conductors; and (b) providing a potting enclosure, said potting enclosure having two apertures in the walls thereof, said apertures being disposed with collinear axes on opposite walls of said potting enclosure, said apertures having a size and shape matching the cross section of said triaxial cable; and (c) inserting a processing circuit assembly into said potting enclosure, and (d) threading said triaxial cable through said apertures in said potting enclosure, such that said exposed three conductors are fully within said potting enclosure; and (e) connecting a second set of three conductors between said exposed three conductors and said processing circuit assembly; and (f) encapsulating with encapsulant said exposed three conductors of said triaxial cable within said potting enclosure, said potting enclosure not being removed after curing of said encapsulant, whereby said method permits said processing circuit assembly to access the electrical signals on said triaxial cable, produces a compact assembly, stabilizes and seals said exposed three conductors, and provides a strain relief means by the wicking of said encapsulant into the internal structure of said triaxial cable past said walls of said potting enclosure, said wicking past said walls being enabled by said apertures having said size and shape matching said cross section of said triaxial cable.

2. The method of claim 1 where the method of connecting said second set of three conductors to said exposed three conductors of said triaxial cable is soldering.

3. The method of claim 1 where the method of connecting said second set of three conductors to said exposed three conductors of said triaxial cable is applying mechanical pressure.

4. The method of claim 1 where the method of connecting said second set of three conductors to said exposed three conductors of said triaxial cable is applying conductive adhesive.

5. The method of claim 1 where said method of encapsulating said triaxial cable connections is encapsulating under a vacuum whereby said encapsulant is drawn into said internal structure of said triaxial cable to create a strain relief.

6. The method of claim 1 where said method of encapsulating said triaxial cable connections is encapsulating under pressure whereby said encapsulant is forced into said internal structure of said triaxial cable to create a strain relief.

7. A triaxial cable connection means which comprises:

(a) a first triaxial cable, and (b) an exposure of the three conductors in said triaxial cable, said exposure created by milling said triaxial cable, without completely severing any of said three conductors; and (c) a potting enclosure with two apertures in the walls thereof, said apertures being disposed with collinear axes on opposite walls of said potting enclosure, said apertures of a size and shape matching the cross section of said triaxial cable; and (d) a disposal of said triaxial cable through said apertures in said potting enclosure, such that said exposed three conductors are fully within said potting enclosure; and (e) a connection of a second set of three conductors between said three conductors of said triaxial cable and a processing circuit assembly, said processing circuit assembly being disposed within said potting enclosure; and (f) an encapsulant disposed on said exposure of the three conductors in said triaxial cable within said potting enclosure, said potting enclosure not being removed after curing of said encapsulant; and (g) a strain relief means comprising said encapsulant and the internal structure of said triaxial cable, said encapsulant curing after wicking into said internal structure of said triaxial cable through said exposure, past said walls of said potting enclosure;

whereby said triaxial cable connection means permits said processing circuit assembly to access the electrical signals on said triaxial cable, produces a compact assembly, stabilizes and seals said exposed three conductors, and provides a strain relief means by said wicking, said wicking past said walls being enabled by said apertures having said size and shape matching said cross section of said triaxial cable.

8. The cable connection means of claim 7 where said connection of said second set of three conductors to said three conductors of said triaxial cable comprises soldered wires.

9. The cable connection means of claim 7 where said connection of said second set of three conductors to said three conductors of said triaxial cable comprises conductors held in contact by physical pressure.

10. The cable connection means of claim 7 where said connection of said second set of three conductors to said three conductors of said triaxial cable comprises conductors held in contact by conductive adhesive.

11. The cable connection means of claim 7 where said encapsulant is drawn into said internal structure of said triaxial cable to create said strain relief means by encapsulating under a vacuum.

12. The cable connection means of claim 7 where said encapsulant is forced into said internal structure of said triaxial cable to create said strain relief means by encapsulating under pressure.

* * * * *